US007681341B2

(12) United States Patent
Ruvang

(10) Patent No.: US 7,681,341 B2
(45) Date of Patent: Mar. 23, 2010

(54) DOUBLE CAM TAPER LOCK CONNECTOR PIN APPARATUS

(75) Inventor: John A. Ruvang, Lake Dallas, TX (US)

(73) Assignee: Hensley Industries, Inc., Dallas, TX (US)

( * ) Notice: Subject to any disclaimer, the term of this patent is extended or adjusted under 35 U.S.C. 154(b) by 189 days.

(21) Appl. No.: 12/031,811

(22) Filed: Feb. 15, 2008

(65) Prior Publication Data

US 2009/0205228 A1 Aug. 20, 2009

(51) Int. Cl.
*E02F 9/28* (2006.01)

(52) U.S. Cl. ..... 37/456

(58) Field of Classification Search ..... 37/452–459, 37/466; 172/701.1–701.3, 713; 403/220, 403/317, 424

See application file for complete search history.

(56) References Cited

U.S. PATENT DOCUMENTS

| | | | |
|---|---|---|---|
| 3,911,782 | A | 10/1975 | Liebig |
| 4,067,657 | A | 1/1978 | Kaarlela |
| 5,410,826 | A | 5/1995 | Immel et al. |
| 5,435,084 | A | 7/1995 | Immel |
| 5,564,206 | A | 10/1996 | Ruvang |
| 5,638,621 | A | 6/1997 | Keech et al. |
| 5,718,070 | A | 2/1998 | Ruvang |
| 5,983,534 | A | 11/1999 | Robinson et al. |
| 5,992,063 | A | 11/1999 | Mack |
| 6,012,886 | A | 1/2000 | Tanamura et al. |
| 6,030,143 | A | 2/2000 | Kreitzberg |
| 6,032,390 | A | 3/2000 | Bierwith |
| 6,108,950 | A | 8/2000 | Ruvang et al. |
| 6,439,796 | B1 | 8/2002 | Ruvang et al. |
| 6,708,431 | B2 | 3/2004 | Robinson et al. |
| 6,799,386 | B2 | 10/2004 | Robinson et al. |
| 6,976,325 | B2 | 12/2005 | Robinson et al. |
| 7,171,771 | B2 | 2/2007 | Briscoe |
| 2003/0070330 | A1 | 4/2003 | Olds et al. |
| 2004/0237354 | A1 | 12/2004 | Emrich |
| 2007/0261278 | A1 | 11/2007 | Campomanes |

FOREIGN PATENT DOCUMENTS

| | | |
|---|---|---|
| AU | 2003264586 | 7/2004 |
| WO | 95/01481 | 1/1995 |

*Primary Examiner*—Robert E Pezzuto
(74) *Attorney, Agent, or Firm*—Haynes and Boone, LLP

(57) ABSTRACT

A hammerless connector pin assembly is insertable in the aligned connector openings in telescoped ground engaging wear and support members and is releasably lockable therein. The inserted assembly has opposite end portions that block removal of the wear member from the support member. Each of the two end portions has a laterally projecting cam member disposed thereon which is positioned within opposite ones of the two opposed wear member connector openings. As the interior surface of the wear member becomes worn from use and is able to shift further rearwardly along the support member, the cam members may simultaneously be rotationally adjusted to maintain contact with the wear member to prevent forward movement thereof away from its rearward shifted position, and then locked in their rotationally adjusted positions.

22 Claims, 9 Drawing Sheets

10
66
64
42
4
30
44
54
40
56
78
4

64
74
76
66
34
72
68
70
42
30
44
40
10
58
60
62
54
32
38
56
80
36
78

DOUBLE CAM TAPER LOCK CONNECTOR PIN APPARATUS

CROSS-REFERENCE TO RELATED APPLICATION

The present application contains subject matter similar to that disclosed in copending U.S. application Ser. No. 11/432,682 which is assigned to the assignee of the present application. Such copending application is hereby incorporated by reference herein in its entirety.

BACKGROUND OF THE INVENTION

The present invention generally relates to ground engaging apparatus and, in representatively illustrated embodiments thereof, more particularly relates to apparatus for releasably coupling a replaceable ground engaging tooth point or other wear member to an associated portion of a support structure, such as an adapter nose. As used herein, the term "ground engaging apparatus" encompasses structure (such as, for example, tooth points and adapters) which is used to actually engage the ground, and other structure (such as, for example, a connector pin assembly) associated with or useable with the structure that actually forcibly engages the ground.

A variety of types of ground engaging apparatus include replaceable wear portions that are removably carried by larger base structures and come into abrasive, wearing contact with the ground material being displaced. For example, ground engaging tooth assemblies provided on digging equipment, such as excavating buckets or the like, typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, generally aligned transverse openings are formed through these interengaged elements adjacent the rear end of the point, and a suitable connector structure is driven into and forcibly retained within the aligned openings to releasably anchor the replaceable tooth point on its associated adapter nose portion. A connector structure may also be driven into the aligned openings of other types of telescoped wear and support members such as, for example, an intermediate adapter mounted on the nose of a base adapter.

The connector structure typically has to be forcibly driven into the aligned wear member and support member nose openings using, for example, a sledge hammer. Subsequently, the inserted connector structure has to be forcibly pounded out of the wear member and support member openings to permit the worn wear member to be removed from the support member and replaced. This conventional need to pound in and later pound out the connector structure can easily give rise to a safety hazard for the installing and removing personnel.

This problem is substantially alleviated by the hammerless connector structure illustrated and described in U.S. Pat. No. 6,439,796 to Ruvang et al, assigned to the assignee of the present invention, the disclosure of such patent being hereby incorporated herein by reference. Basically, this hammerless connector structure comprises two longitudinal threaded connector pin sections which are longitudinally inserted toward each other through the wear member and support member connector openings and then threaded together within the interior of the support member opening. Illustratively, the two threaded-together connector pin sections are held in place within the wear member and support member openings by a resilient member compressed between the two connector pin sections or by an internal support member ledge portion interposed between annular ledge portions of the threaded-together connector pin sections. When desired, the inserted connector pin structure may be removed by simply unscrewing the two pin sections from one another and removing them from the wear member and support member openings.

While this design eliminates the need to pound in and then pound out the connector pin structure, it is not operative to compensate for operational surface interface wear between the nose portion of the support member and the wear member which is telescoped onto the nose. Such surface interface wear permits the wear member to move back and forth on the support member nose toward and away from the original installed orientation of the wear member. This, in turn, undesirably accelerates the surface interface wear between the wear member and the support member within the wear member socket area.

In view of the foregoing it can readily be seen that a need exists for a hammerless connector pin structure that is provided with the capability of adjusting for the "loosening" wear between an excavating support member and a wear member telescoped onto the support member. It is to this need that the present invention is primarily directed.

SUMMARY OF THE INVENTION

In carrying out principles of the present invention, in accordance with representatively illustrated embodiments of specially designed ground engaging apparatus, a novel connector pin assembly is provided for captively and releasably retaining a replaceable ground engaging wear member on a support member. Illustratively, the wear and support members may respectively be a tooth point and an adapter, or an intermediate adapter and a base adapter.

The wear member is representatively of a hollow, tapered configuration and is rearwardly telescoped onto a similarly tapered nose portion of the support member. When it is initially installed over the support member nose portion, the wear member may move rearwardly along the nose portion to an initial rear limit or "tightened" orientation. However, after the overall wear member/support member structure is used for a time the tremendous ground engaging forces that the structure is typically subjected to cause significant surface wear at the interior interface between the wear and support members. This undesirably "loosens" the wear member and permits it to shift rearwardly along the support member to a rearwardly shifted tightened orientation. During ground engaging operations, such as excavation, this, in turn, permits the wear member to forwardly and rearwardly "rattle" on the support member in a manner undesirably accelerating abrasion wear at the support member/wear member surface interface.

With the wear member operatively telescoped onto the support member nose, first and second connector openings in opposite side wall portions of the wear member are generally aligned with a connector opening extending through the nose. In representatively illustrated embodiments thereof, the connector pin assembly is advantageously of a "hammerless" construction which permits it to be placed in and removed from the aligned connector openings without pounding on the assembly with a sledge hammer or other driving implement. When the connector pin assembly is installed in these openings, opposite end portions of the assembly extend into the wear member connector openings and serve to block forward removal of the wear member from the support member.

Illustratively, the connector pin assembly comprises a tubular sleeve member, a pin structure, and locking structure. The sleeve member has an interior surface area and is configured to be inserted into, and rotationally locked within, a connector opening of the support member. The pin structure has a longitudinally intermediate portion and generally cam-shaped outer end portions, with the longitudinally intermediate portion being rotatably positionable within the sleeve member with the outer end portions disposed externally of the sleeve member.

The generally cam-shaped outer end portions of the pin structure are lockable in identical rotational orientations relative to the longitudinally intermediate pin structure portion in response to insertion of the longitudinally intermediate portion into the sleeve member. The locking structure is selectively operable to forcibly engage the longitudinally intermediate pin structure portion with the interior sleeve member surface portion and disengage the longitudinally intermediate pin structure portion therefrom to respectively rotationally lock and unlock the longitudinally intermediate pin structure portion within the sleeve member.

The configuration of the connector pin assembly permits it to be installed in and removed from the telescoped wear and support members without having to pound the pin assembly in or out. Moreover, the dual cam end portions of the pin structure may be used to selectively "retighten" the wear member on the support member after surface interface wear between such members permits the wear member to shift further rearwardly along the support member. This may be achieved by simply loosening the locking structure to permit the pin structure to be rotated relative to the sleeve member (which is nonrotatably received in the sleeve member), appropriately rotating the rotationally coupled cammed outer pin structure ends to cause them to engage rear portions of the wear member openings with the wear member shifted to its new rear limit position, and then re-tighten the tightening structure to lock the cammed outer pin structure ends in their rotationally adjusted orientations relative to the sleeve member. This causes the cammed end portions to block forward movement of the wear member from its new rearwardmost orientation on the support member.

According to various aspects of the invention, the interior surface area of the sleeve member, against which the longitudinally intermediate pin structure may be locked by the locking structure, is angled relative to the tubular sleeve member axis, being either tapered or transverse with respect thereto and being forcibly abuttable by a complementarily configured surface area of the longitudinally intermediate pin structure portion to thereby prevent rotation of the pin structure relative to the sleeve member. These surface areas may also be configured to mechanically interlock with one another to mechanically block rotation of the pin structure relative to the sleeve member in addition to using frictional forces between such surface areas to preclude such relative rotation. This additional mechanical interlock (which may be used without an additional appreciable frictional force) may be in various forms such as, by way of non-limiting examples, serrations, splines or keys.

According to other aspects of the invention, the longitudinally intermediate portion of the pin structure is preferable formed from two separate longitudinal pin sections having inner ends that, in response to insertion into the sleeve member through opposite ends thereof, are longitudinally overlappable and interlockable in a manner locking the two pin sections against relative rotation therebetween, and placing the cammed outer pin structure end portions in identical rotational orientations relative to the sleeve member. This interlock between the two inner pin section ends may be achieved in a variety of manners including, by of non-limiting examples, serrations, keys, splines and other types of complementary configurations on the inner pin section ends.

DETAILED DESCRIPTION

Figure 1:
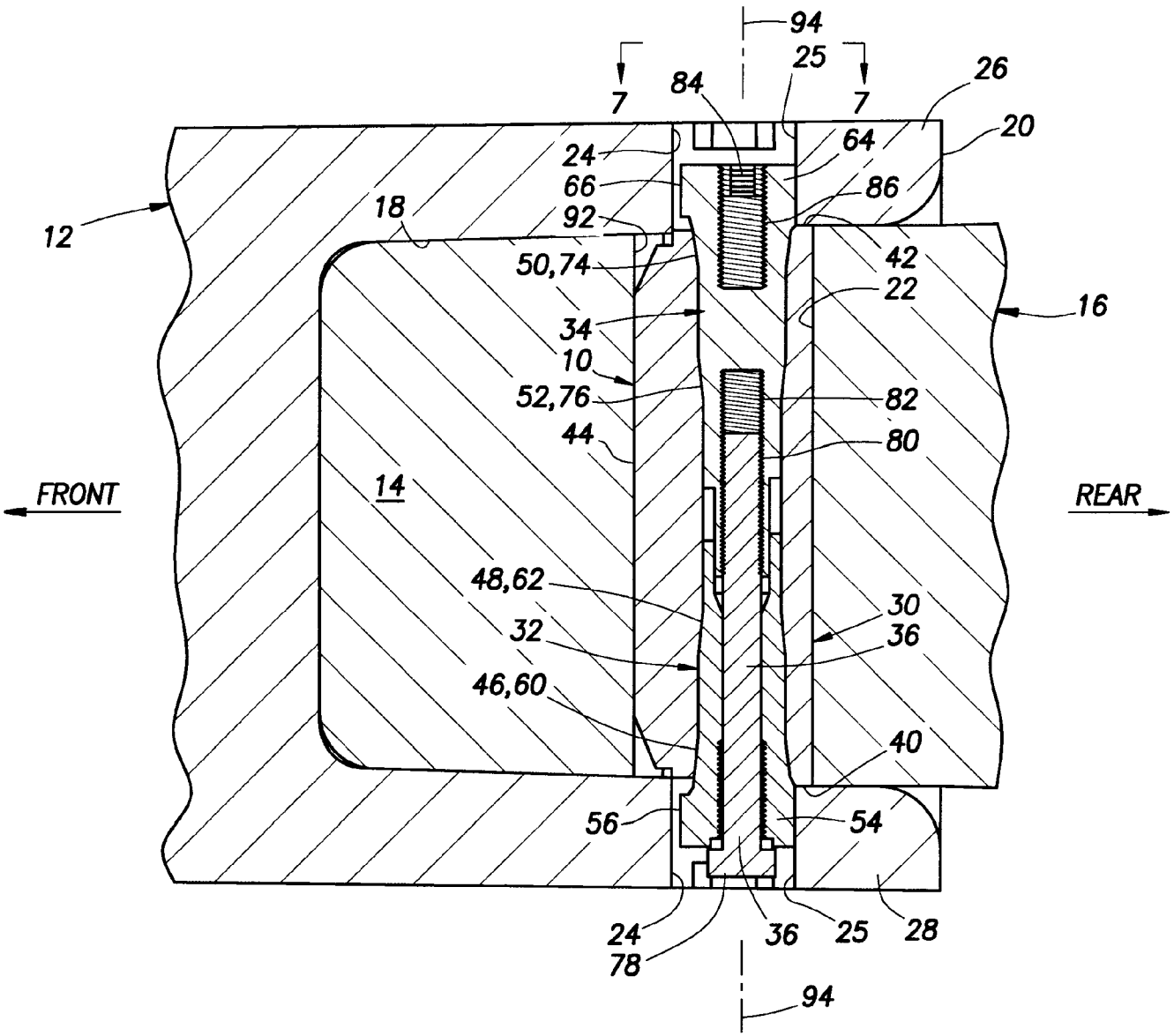
FIG. 1 is a longitudinally foreshortened cross-sectional view of a nose portion of a ground engaging support member and a replaceable wear member telescopingly received on the nose portion of the support member and releasably held thereon by a specially designed double cammed connector pin assembly embodying principles of the present invention.

In a representatively illustrated embodiment thereof the present invention provides a specially designed double cam connector pin assembly 10 that is used to releasably hold a ground engaging wear member, representatively a tooth point 12 (see FIG. 1) on the nose 14 of an associated ground engaging support member, representatively an adapter structure 16. It will be appreciated by those of skill in this particular art that other types of ground engaging wear members and associated support structures could alternatively be releasably coupled using the connector pin assembly 10. As but one non-limiting example, the wear member 10 could be an intermediate adapter, and the support member 16 could be a base adapter.

With continuing reference to FIG. 1, the replaceable tooth point 12 has an internal socket 18 extending in a forward direction inwardly from its rear end 20, with the tapered adapter nose 14 being complementarily received in the socket 18. A transverse, circularly cross-sectioned connector opening 22 extends transversely through the adapter nose 14 and is generally aligned with corresponding connector openings 24 formed in opposite side wall portions 26,28 of the tooth point 12. Each opening 24 has a rear surface portion 25. In a manner subsequently described herein, the connector pin assembly 10 is inserted into the aligned openings 22,24 and is retained therein to thereby releasably retain the tooth point 12 in place on the adapter nose 14 and block its forward removal therefrom.

As will be seen, the connector pin assembly 10 provides substantial improvements with respect to connector pin structures which must be pounded into and out of the aligned adapter nose and tooth point openings 22,24. Previously utilized "pound-in" pin structures have several disadvantages including the inherent hazards of having to pound them into and out of the connector openings with a sledge hammer, and the possibility that operational impact loads imposed on the inserted pin structure will dislodge it from the tooth/adapter assembly.

Referring now to FIGS. 2-5, the specially designed connector pin assembly 10 includes a hollow tubular body in the form of a sleeve member 30, first and second hollow tubular longitudinal pin sections 32 and 34, a tightening structure in the form of a bolt 36 and a lock washer 38.

Sleeve member 30 has opposite ends 40,42 and a laterally outwardly projecting external key or spline 44 extending along its length. Spline 44 can, as shown, be integral with the balance of the sleeve member 30 or be removably secured thereto. Formed on the interior side surface of the sleeve member 30 are two longitudinally spaced apart annular surface areas 46,48 adjacent the end 40 of the sleeve member 30 which are tapered in longitudinally and radially inward directions, and two longitudinally spaced apart annular surface areas 50,52 adjacent the end 42 of the sleeve member 30 which are tapered in longitudinally and radially inward directions.

Pin section 32 has a laterally enlarged, eccentrically configured outer end portion 54 which is representatively cam-shaped and has a lobe portion 56. An inner end portion of the pin section 32 has a circumferentially extending slot 58 formed therein. Between the cam 54 and the slot 58 longitudinally spaced apart annular side surface areas 60,62 of the pin section 32 are provided with longitudinally and radially inwardly tapered configurations which, respectively, are complementarily engageable with the tapered surface areas 46,48 within the interior of the sleeve member 30.

Pin section 34 has a laterally enlarged, eccentrically configured outer end portion 64 which is representatively cam-shaped, has a lobe portion 66, and a shape identical to that of the cam 54 on pin section 32. An inner end portion of the pin section 34 has a circumferentially extending external surface groove formed therein which defines a pair of stop surfaces 68 circumferentially spaced apart along a resulting reduced diameter portion 70 of the pin section 34 adjacent a remaining original diameter portion 72 thereof (see FIG. 5). Between the cam 64 and the reduced diameter portion 70, longitudinally spaced apart annular side surface areas 74,76 of the pin section 34 are provided with longitudinally and radially inwardly tapered configurations which, respectively, are complementarily engageable with the tapered surface areas 50,52 within the interior of the sleeve member 30.

Bolt 36 has a head portion 78, and a threaded inner end portion 80. As later described herein, the bolt 36 is utilized as a tightening structure to longitudinally tighten and loosen the pin sections 32,34 within the interior of the sleeve member 30 during assembly of the overall connector pin assembly 10 in which the pin sections 32,34 collectively define a pin structure portion thereof, such pin structure having a longitudinally intermediate portion extending between the cams 54,64.

To assemble the illustrated connector pin assembly 10, the longitudinal pin sections 32,34 are respectively inserted, inner ends first, into the opposite ends 40,42 of the sleeve member 30 until the complementarily configured inner ends of the inserted pin sections 32,34 longitudinally overlap and interlock in a manner precluding relative rotation therebetween. As can best be seen in FIG. 5, when the inner pin section ends are interlocked in this manner, the stop surfaces 68 on the pin section 34 form circumferential abutments for opposite edge portions of the inner end of the pin section 34 (at opposite sides of the slot 58 therein) to thereby prevent such relative rotation between the interlocked pin sections 32,24.

The inner ends of the pin sections 32,34 are relatively configured in a manner such that they can only be interlocked in this relative rotation-precluding manner if the cams 54,64 are in identical rotational orientations relative to the sleeve member 30—i.e., with the cam lobes 56,66 pointing in the same lateral direction relative to the sleeve member 30.

Figure 6:
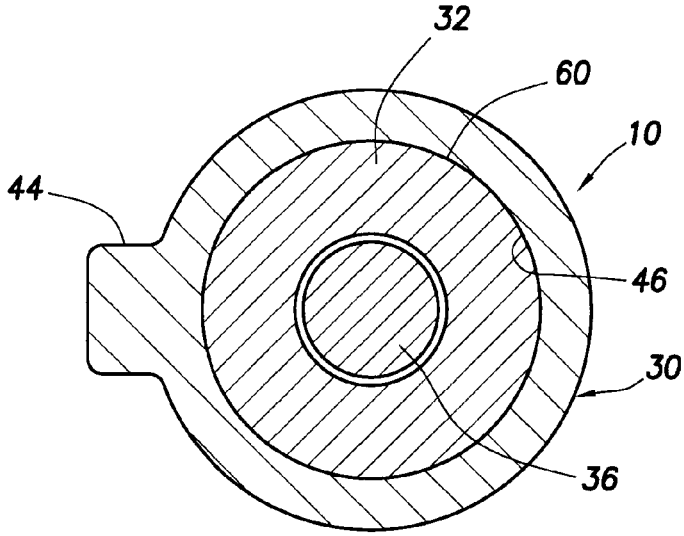
FIG. 6 is a full cross-sectional view through the assembled connector pin assembly taken along line 6-6 of FIG. 4.

Next, the bolt 36 is extended through the lock washer 38, inserted into the outer end of the pin section 32 and partially tightened into an internally threaded portion 82 of the pin section 34. A portion of a suitable rotational adjustment tool (not illustrated) may then inserted into a square or hexagonally shaped (or otherwise noncircularly cross-sectioned) drive recess 84 extending inwardly through the outer end of the pin section 34 to a circularly cross-sectioned interiorly threaded area 86 therein. The tool may then be rotated to position the cams 54,64 (which, as illustrated, are disposed externally adjacent the opposite ends 40,42 of the sleeve member 30) in desired identical rotational orientations relative to the sleeve member 30. Finally, the bolt 36 may then be further tightened to rotationally lock the pin sections 32,34 relative to the sleeve member 30 by moving the pin sections 32,34 toward one another to thereby create a forcible frictional engagement between the pin section tapered surface areas 60,62,74,76 and their associated sleeve member tapered interior side surface areas 46,48,50,52 (see FIGS. 4 and 6) to also rotationally lock the cams 56,56 relative to the sleeve member 30.

If desired, a variety of alternate methods could be utilized to create the desired "single rotational orientation" interlock between the inserted pin sections 32,34, and the rotational locking of the pin sections 32,34 within the sleeve member 30, without departing from principles of the present invention.

Figure 5:
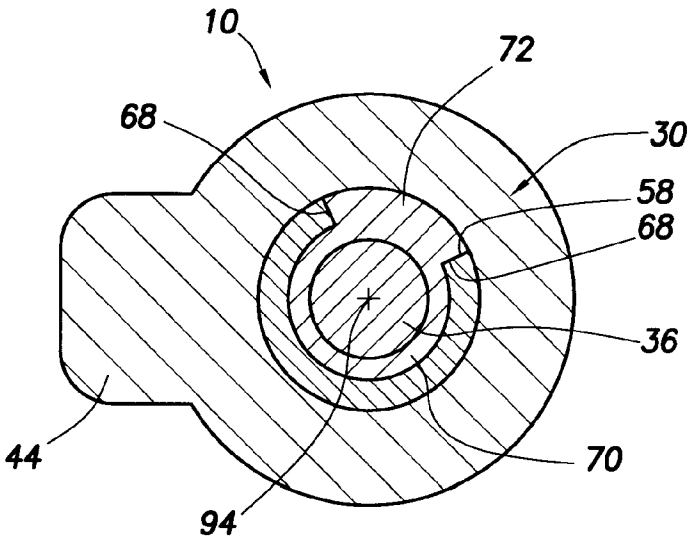
FIG. 5 is a full cross-sectional view through the assembled connector pin assembly taken along line 5-5 of FIG. 4.
Figure 5A:
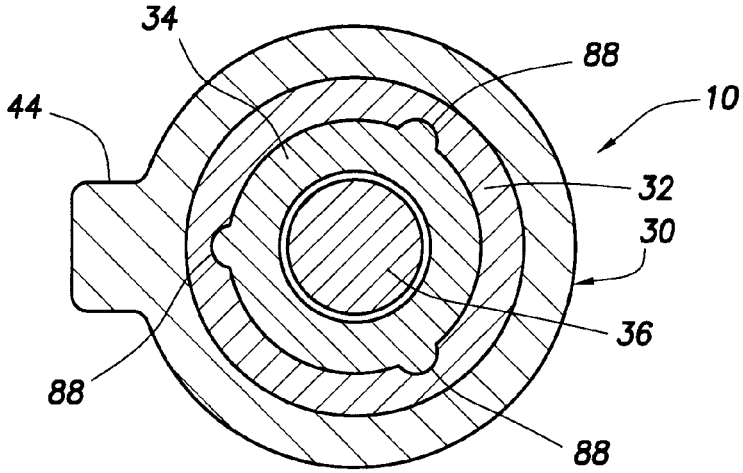
FIG. 5A is view similar to that in FIG. 5 but illustrating an alternate internal configuration of the connector pin assembly.
Figure 6A:
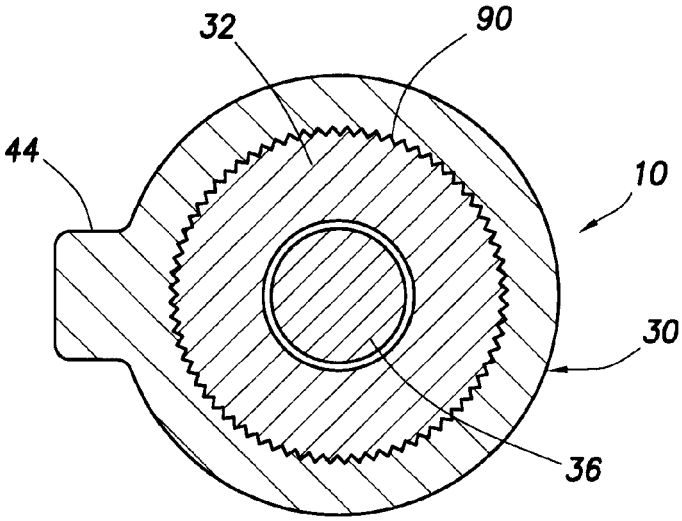
FIG. 6A is a view similar to that in FIG. 6 but illustrating an alternate internal configuration of the connector pin assembly.

By way of non-limiting example, as cross-sectionally illustrated in FIG. 5A, the desired interlock between the inserted pin sections 32,34 could also be effected using circumferentially and unequally spaced external splines 88 disposed on the pin section 34 and received in corresponding interior side surface grooves on the pin section 32 (or splines on the pin section 32 and grooves on the pin section 34), or key members received in grooves in the pin sections 32,34. In each of these alt Also by way of non-limiting example, the tapered surface frictional interlock between the pin sections 32,34 and the interior side surface of the sleeve member 30 may be augmented by additionally providing a mechanical interlock between the tapered pin section and sleeve member surfaces. This could be achieved, as illustratively shown in FIG. 6A, by forming interlocking serrations 90 on the tapered surface areas of the pin sections 32,34 and the sleeve member 30. Alternatively, splines or key members could be utilized to provide this mechanical interlock which blocks rotation of the pin sections 32,34 relative to the sleeve member 30.

Referring again to FIG. 1, to use the specially designed connector pin assembly 10 to captively retain the tooth point 12 on the adapter nose 14, and to adjustably tighten the tooth point 12 thereon as operational wear the point and adapter nose permits further rearward movement of the tooth point on the adapter nose, the sleeve member 30 is first inserted into the adapter nose connector opening 22 in a manner such that the sleeve member spline 44 is received in a groove 92 formed in the interior side surface of the adapter nose connector opening 22. This serves to prevent rotation of the inserted sleeve member 30, about its longitudinal axis 94, relative to the adapter nose 14.

The tooth point 12 is then rearwardly telescoped onto the adapter nose 14 to an "initially tightened" position of the tooth point 12 in which the adapter nose 14 precludes further rearward movement of the tooth point 12. As can be seen in FIG. 1, the installed tooth point 12 blocks axial removal of the inserted sleeve member 30. Then, as previously described herein, the pin sections are inserted into the opposite ends of the sleeve member 30 and the bolt 36 is inserted and partially tightened to the pin section 34 which is non-rotationally interlocked to the inserted pin section 32. This positions the cams 54,64 within the tooth point side wall openings 24.

Figure 7:
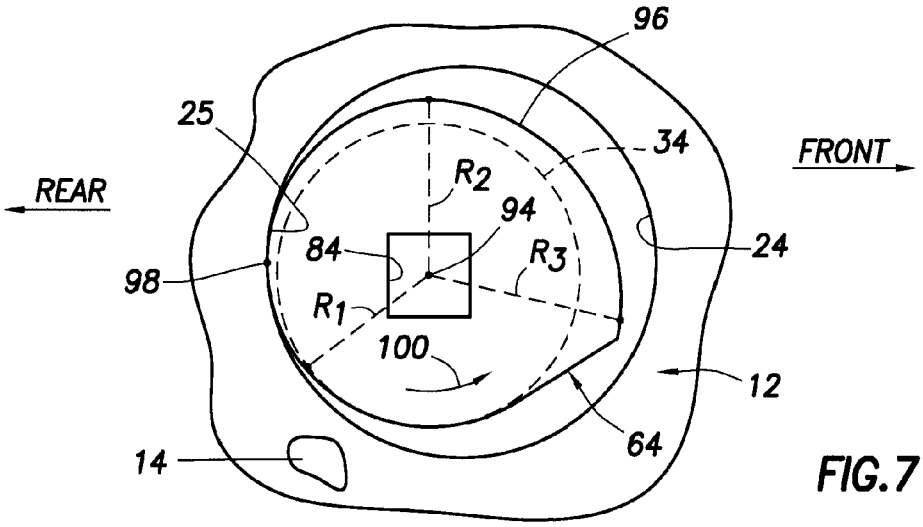
FIG. 7 is a side elevational view of a portion of the telescoped wear and support members, taken along line 7-7 of FIG. 1, illustrating the rotational orientation of a cammed end portion of the double cam connector pin assembly, and the relative front-to-rear orientations of the wear member and support member nose, when the wear member is initially installed and rearwardly tightened on the support member nose.

Next, with reference to FIG. 7, using a suitable tool (not illustrated) inserted into the noncircular cam opening 84, the cam 64 (and thus the identically oriented cam 54 rotationally locked thereto via the interlocked pin sections 32,34) is rotated until its eccentrically curved, convoluted side surface 96 contacts the adjacent rear side surface 25 of the tooth point side wall opening 24 (illustratively at point 98) in which the cam is received. As can be seen in FIG. 7, the generally radial distances $R_1$, $R_2$ and $R_3$ from the longitudinal axis 94 of the sleeve member 30 to the eccentrically curved side surface portion 96 of the cam 64 progressively increase in a clockwise direction around the surface 96. Accordingly, to "tighten" the tooth point 12 on the adapter nose 14 as later described herein, the cam 54 is rotated in a counterclockwise direction, as indicated by the arrow 100 in FIGS. 7-7B.

With the cam 64 contacting the point 98 as shown in FIG. 7 (with the cam 54 similarly contacting the rear side surface 25 of the other tooth point opening 24), the installed tooth point 12 is in an "initially tightened" orientation on the adapter nose 14 and is blocked by the cams 54,64 from shifting forwardly from this initial orientation on the adapter nose 14. Finally, the bolt 36 is further tightened to forcibly engage the tapered pin section surfaces 60,62,74,76 with their associated tapered sleeve member surfaces 46,48,50,52 to thereby rotationally lock the pin sections 32,34 (and thus the cams 54,64) relative to the sleeve member 30.

Figure 7A:
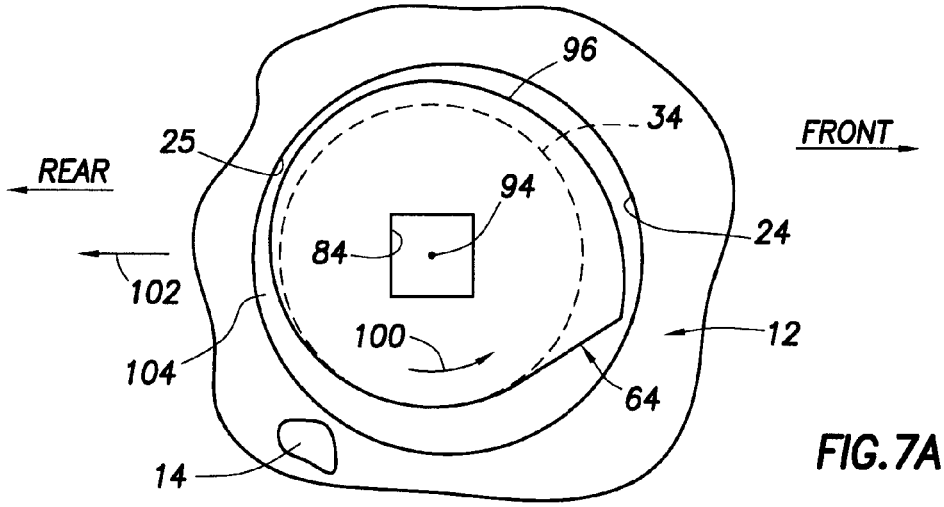
FIG. 7A is a view similar to that in FIG. 7, but illustrating a rearward shifting of the wear member relative to the support member nose permitted by operational surface interface wear between the nose and the wear member within the wear member pocket.
Figure 7B:
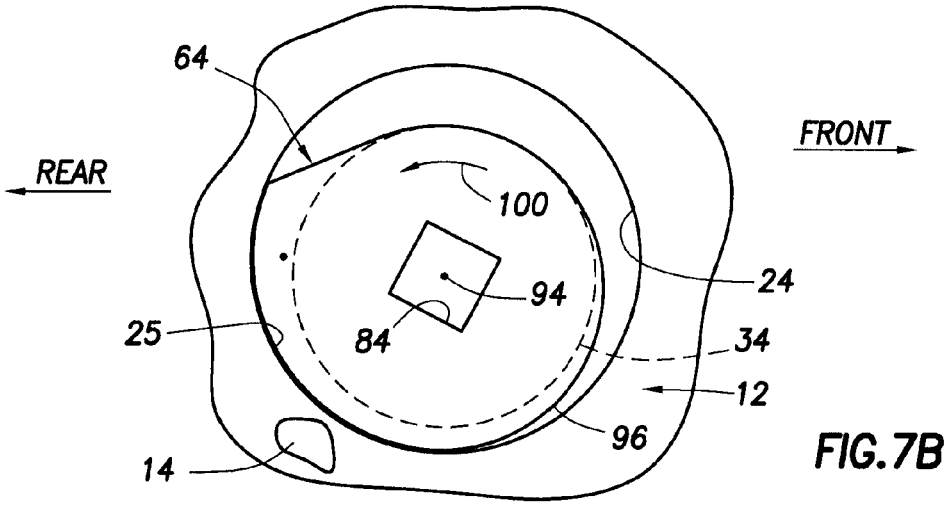
FIG. 7B is a view similar to that in FIG. 7A, but illustrating a simple rotational adjustment of the illustrated cammed connector pin end portion that causes it to rearwardly re-engage the rearwardly shifted wear member and, together with the simultaneously adjusted opposite cammed end portion of the connector pin assembly, prevent the wear member from shifting forwardly along the support member nose, thereby "retightening" the rearwardly shifted wear member on the support member nose.

Turning now to FIG. 7A, after a period of ground engaging use of the telescoped wear and support members 12,14 their interfacing surfaces within the pocket 18 (see FIG. 1) will begin to wear away in a manner "loosening" the fit of the wear member 12 on the support member 14. This permits the wear member 12 to rearwardly shift away from its FIG. 7 initially tightened position on the support member 14 and thereby shift rearwardly out of engagement with the surfaces 58 of the cams 54 and 64 as indicated by the shift arrow 102 in FIG. 7A, and create gaps 104 between the curved surfaces 96 of the cams 54,64 and the rear sides 25 of the wear member side wall openings 24. As can be seen, the presence of these gaps 104 permits the wear member 12 to undesirably shift forwardly and rearwardly on the support member 14 (i.e., between its FIG. 7A position and a forwardly shifted position in which the wear member 12 again forwardly abuts the cam surfaces 96), thereby rattling on the support member 14 and aggravating the wear at the wear member/support member surface interface in the pocket 18.

The unique use on the specially designed connector pin assembly 10 of the two cams 54,64, which serve as wear member tightening adjustment members, permits the now loosened wear member 12 to be retightened on the support member 14 in a simple manner. To effect this retightening, the bolt 36 is simply loosened and the cam 64 rotated in a counterclockwise direction, as indicated by the arrow 100 in FIG. 7B until, as shown in such figure, the cam 64 is brought back into blocking contact with the rearwardly shifted rear surface portion 25 of the wear member side wall opening 24 (thereby making the same tightening adjustment of the other cam 54). In this manner, undesirable front-to-rear rattling of the wear member 12 caused by operational interior abrasion wear thereof may be easily and quickly eliminated by simply rotationally adjusting the two rotationally coupled cams 54,64.

When it becomes necessary to replace the wear member 12 with a new one, the pin sections 32,34 are simply removed, to permit removal of the old wear member and installation of the new one, and then re-installed. To facilitate removal of the pin sections a threaded portion of a suitable removal tool may be threaded into the threaded interior portion 86 of the pin section 34 to help in pulling it out of the sleeve member 30, and the threaded portion of the removal tool then threaded into a corresponding interior threaded portion 106 in the pin section 32 (see FIG. 4) to facilitate its pull-out removal as well. A suitable anti-seize compound may be applied to the tapered surfaces of the pin sections 32,34 before they are installed to make their subsequent removal from the sleeve member 30 easier.

Figures 8, 9:
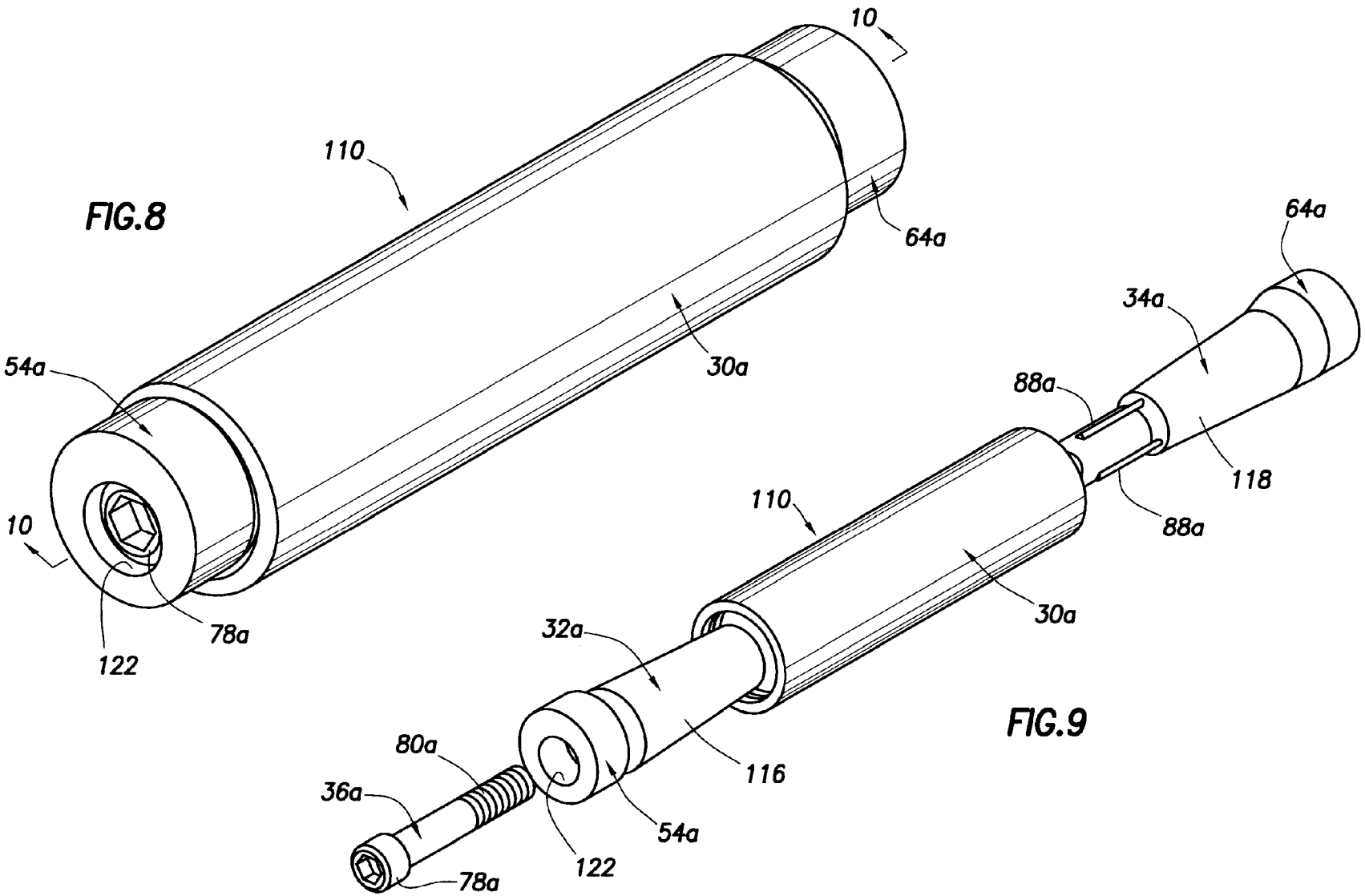
FIG. 8 is an assembled perspective view of a first alternate embodiment of the cammed connector pin assembly.
FIG. 9 is an exploded perspective view of the FIG. 8 first alternate cammed connector pin assembly embodiment.
Figure 10:
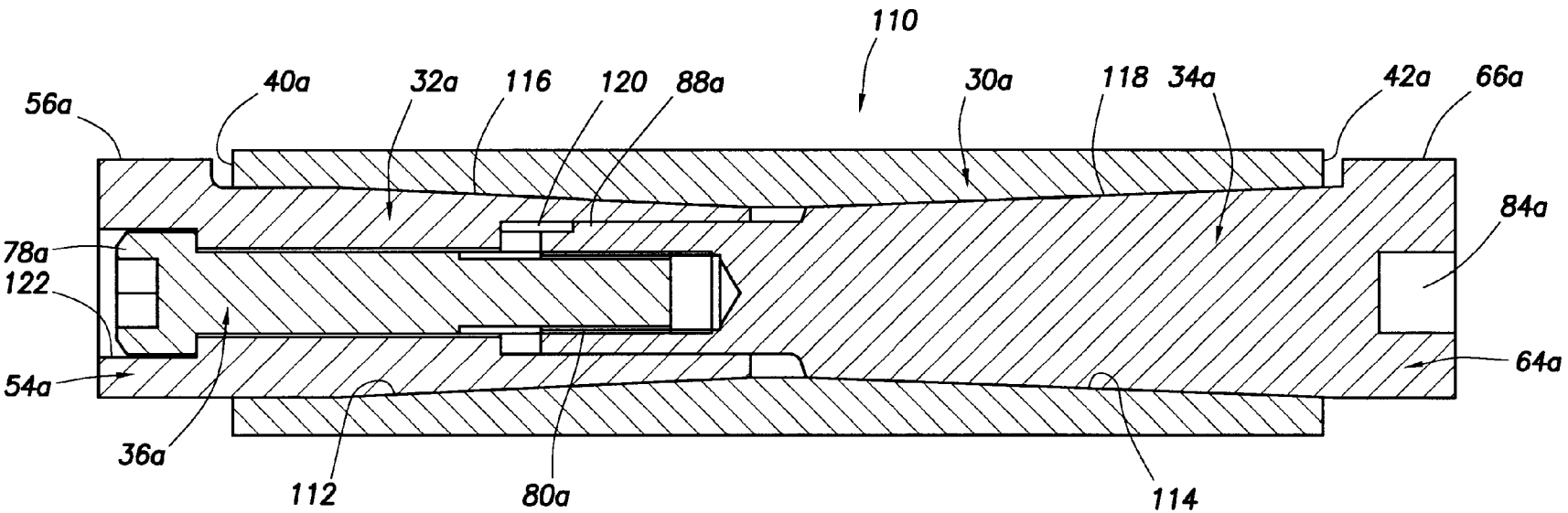
FIG. 10 is a cross-sectional view through the FIG. 8 first alternate cammed connector pin assembly embodiment taken along line 10-10 of FIG. 8.

A first alternate embodiment 110 of the previously described connector pin assembly 10 is illustrated in FIGS. 8-10. In order to facilitate a comparison between the embodiments 110 and 10, components in the connector pin assembly 110 similar to those in connector pin assembly 10 have been given the same reference numerals to which the subscripts "a" have been appended.

The sleeve member portion 30*a* of the connector pin assembly 110 has oppositely sloped annular longitudinally tapered interior surface areas 112,114 (see FIG. 10) that continuously extend from a longitudinally central interior area of the sleeve member 30*a* to its opposite ends 40*a* and 42*a*.

Complementarily configured longitudinally tapered side surface areas 116,118 are respectively formed on the connector pin sections 32*a*,34*a* as shown in FIGS. 9 and 10. To rotatably couple the pin sections 32*a*,34*a* upon their insertion into the sleeve member 30*a*, splines 88*a* are formed on a reduced diameter inner end portion of the pin section 34*a*, and are unequally spaced around its circumference. Splines 88*a* are receivable in corresponding grooves 120 in the interior of the pin section 32*a*, as may be best seen in FIG. 10) to rotationally lock the pin sections 32*a*,34*a* within the interior of the sleeve member 30*a* and thereby hold the cams 54*a*,64*a* in identical rotational orientations relative to the sleeve member 30*a*. As illustrated, the installed socketed bolt head 78*a* is protectively recessed in a central opening 122 in the cam 56*a*.

Figures 2, 3:
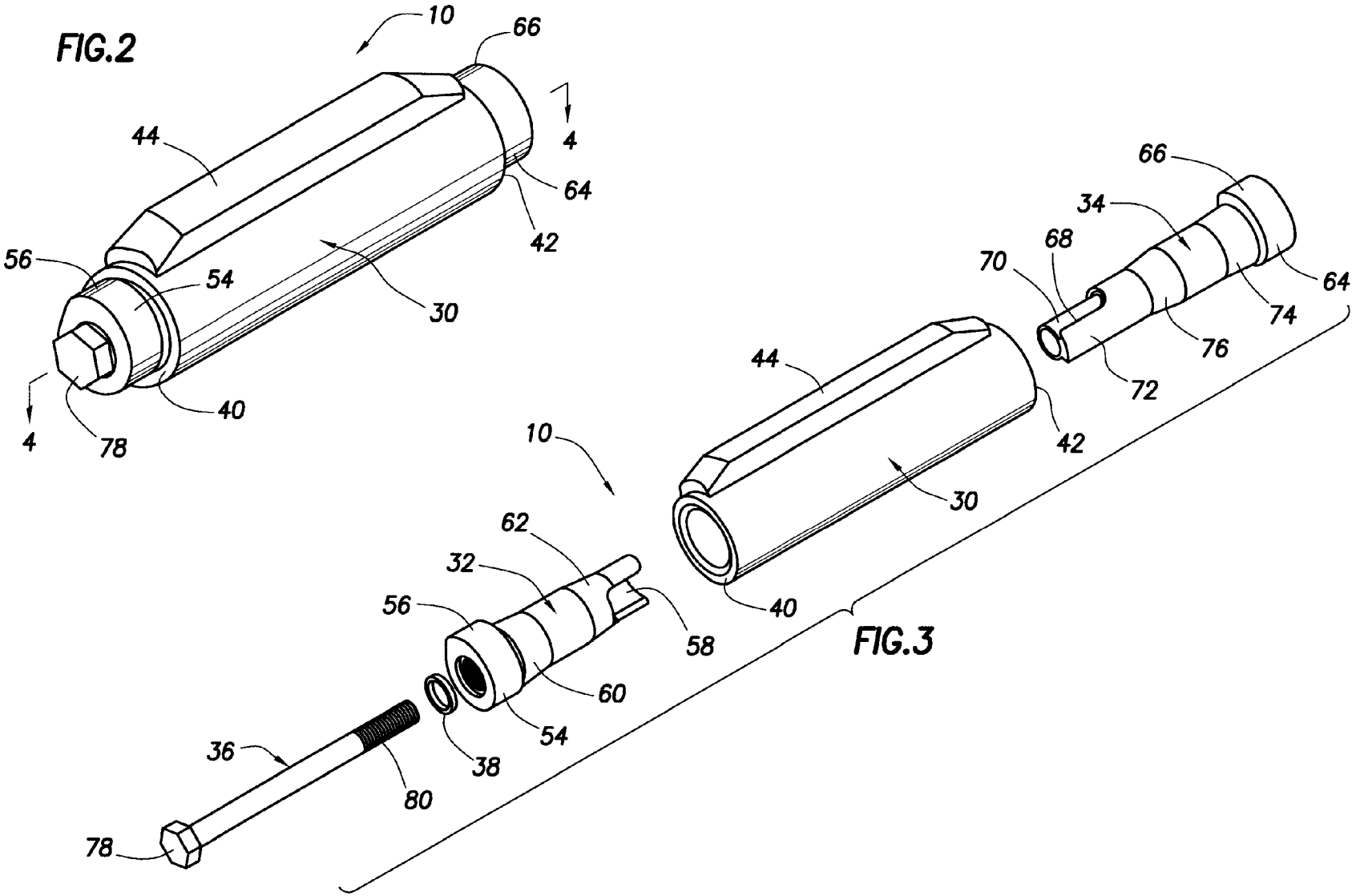
FIG. 2 is an assembled perspective view of the connector pin assembly removed from the wear and support members.
FIG. 3 is an exploded perspective view of the connector pin assembly.
Figure 4:
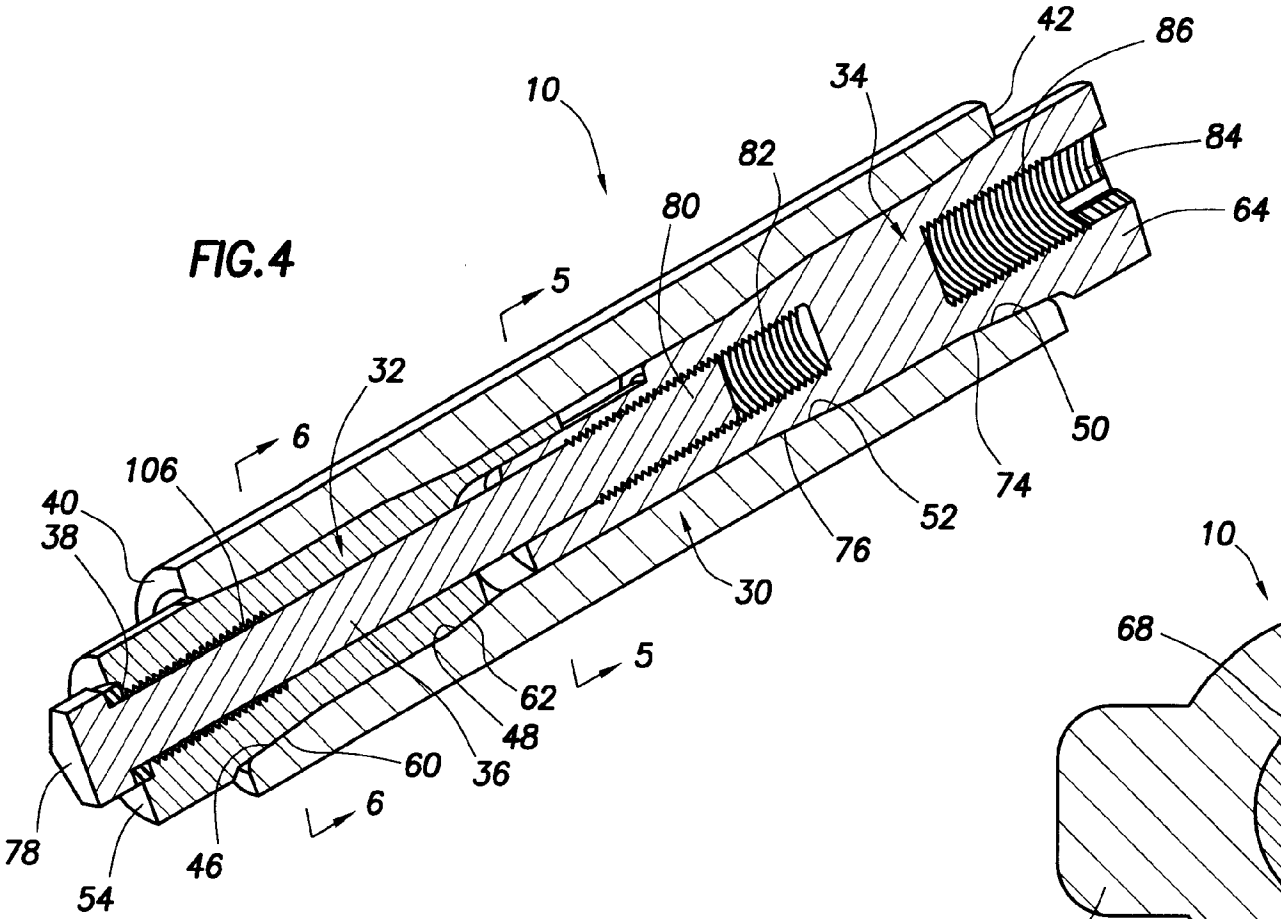
FIG. 4 is a cross-sectional view through the assembled connector pin assembly taken along line 4-4 of FIG. 2.

Connector pin assembly 110 may be operatively installed on the telescoped wear and support members 12,14 (see FIG. 1), and adjusted thereon, in the same manner as previously described for the connector pin assembly 10. In a similar fashion, the mechanical interlock between the pin sections 32*a*,34*a* may be effected in a variety of alternate manners including, by way of non-limiting examples, a complementary contouring of their inner ends as shown in FIGS. 3 and 5, alternate splining arrangements, and removable key members. Also, the tapered surface frictional engagement between the pin sections 32*a*,34*a* and the sleeve member 30 may be augmented by various mechanically interlocking arrangements such as those previously discussed in conjunction with the pin sections 32 and 34

Figure 11:
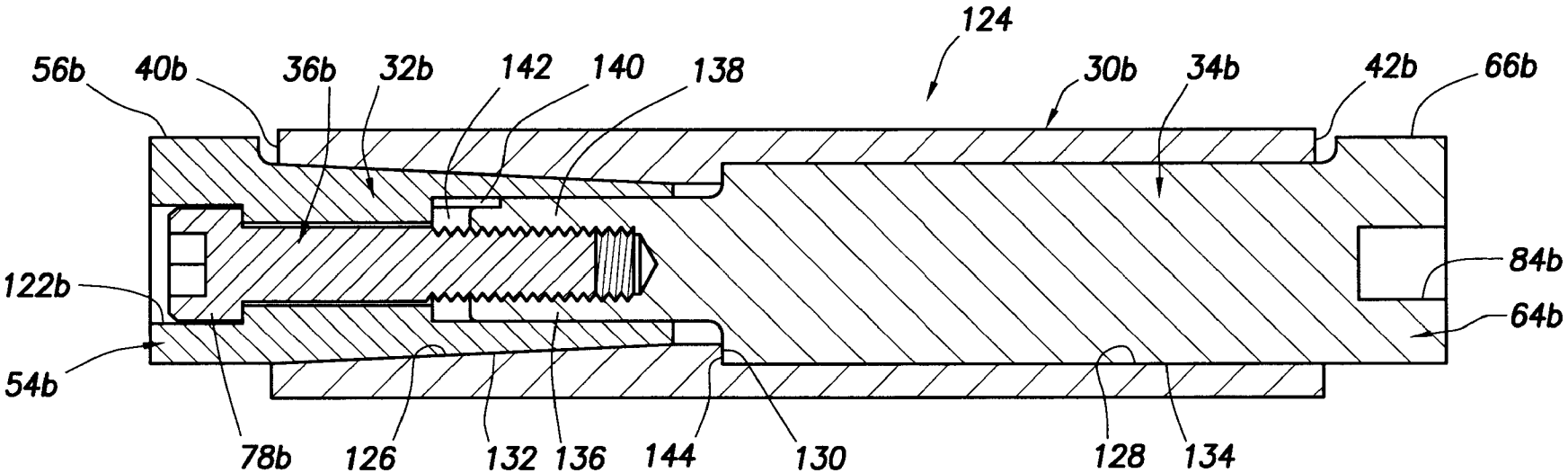
FIG. 11 is a cross-sectional assembled view of a second alternate embodiment of the cammed connector pin assembly.

An assembled second alternate embodiment 124 of the previously described connector pin assembly 10 is cross-sectionally illustrated in FIG. 11. In order to facilitate a comparison between the embodiments 124 and 10, components in the connector pin assembly 124 similar to those in connector pin assembly 10 have been given the same reference numerals to which the subscripts "b" have been appended.

In the connector pin assembly 124 the sleeve member 30*b* has an annular longitudinally and radially inwardly tapered surface area 126 extending inwardly from its end 40*b*, and an untapered interior surface area 128 extending through the longitudinal balance of the sleeve member 30*b*. At the juncture of the interior surface areas 126,128 is an annular interior shoulder 130 that faces the end 42*b* of the sleeve member 30*b*.

Pin section 32*b* has a tapered outer side surface portion 132 complementary to the tapered sleeve member interior surface 126, and pin section 34*b* has a non-tapered outer side surface portion 134 complementarily configured relative to the sleeve member surface 128. A reduced diameter inner end portion 136 of the pin section 34*b* has a plurality of exterior splines 138 unequally spaced around its side surface periphery, with the splines 138 being slidably received in corresponding grooves 140 in the interior of an inner end opening 142 of the pin section 32*b*.

With the bolt 36*b* threadingly tightened into the hollow inner end portion 136 of the pin section 34*b*, the annular ledge 130 is forcibly engaged with a facing annular ledge 144 on the pin section 34*b*, and the annular tapered surfaces 126,132 are wedgingly engaged in a manner preventing rotation of the rotationally locked pin sections 32*b*,34*b* relative to the sleeve member 30*b*. As in the case of the previously described connector pin assembly embodiments, the rotational locking of the pin sections 32*b*,34*b* could be alternatively achieved by other means such as, by way of non-limiting examples, splines, serrations or keys, and the locking within the sleeve member 30*b* of the interlocked pin sections 32*b*,34*b* could also be achieved by other means such as, by way of non-limiting examples, splines, serrations, keys and the like.

The illustrated connector pin assembly 124 can be installed within the aligned openings 22,24 in the telescoped wear and support members 12,14 (see FIG. 1) in a manner similar to that utilized in conjunction with the previously described connector pin assembly embodiments, and the cams 54*b*,64*b* simultaneously rotationally adjusted by simply loosening the bolt 36*b*, simultaneously rotating the pin-coupled cams to new rotational orientations and then re-locking the cams in their "retightening" orientations by re-tightening the loosened bolt 36*b*.

Figure 12:
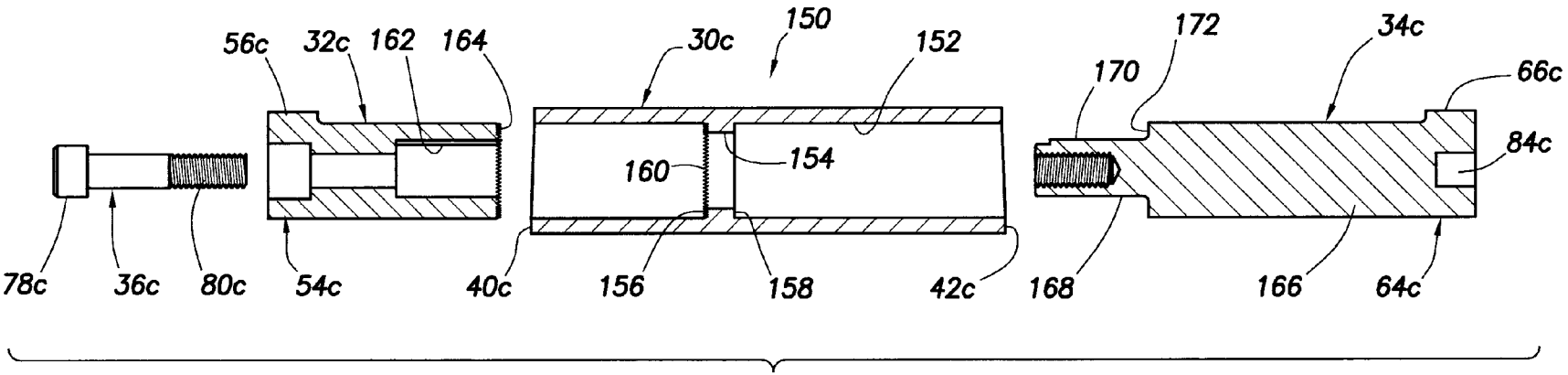
FIG. 12 is an exploded partly elevational cross-sectional view of a third alternate embodiment of the cammed connector pin assembly.
Figure 13:
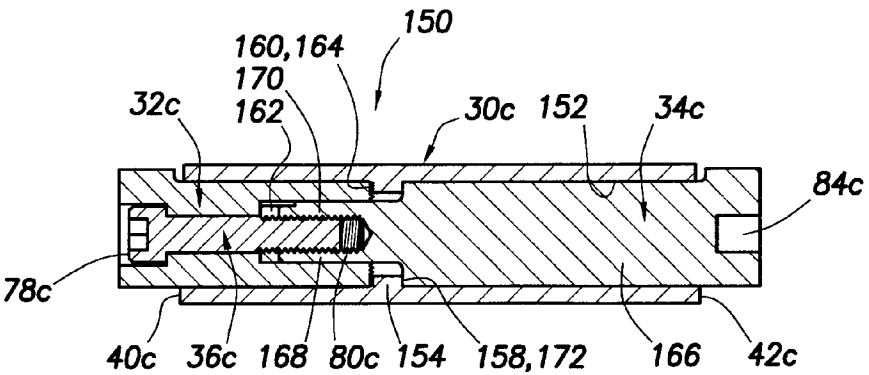
FIG. 13 is a cross-sectional assembled view of the third alternate cammed connector pin assembly embodiment.

A third alternate embodiment 150 of the previously described connector pin assembly 10 is cross-sectionally illustrated in FIGS. 12 and 13. In order to facilitate a comparison between the embodiments 150 and 10, components in the connector pin assembly 150 similar to those in connector pin assembly 10 have been given the same reference numerals to which the subscripts "c" have been appended.

In the connector pin assembly 150, the interior side surface 152 of the tubular sleeve member 30*c* is untapered along its length. An annular shoulder 154 is formed in a longitudinally intermediate portion of the sleeve member 30*c* and has opposite side surfaces 156,158 respectively facing the opposite ends 40*c*,42*c* of the sleeve member 30*c*. A circumferentially extending series of serrations 160 are formed on the annular side surface 156.

Pin section 32*c* has the indicated hollow configuration, and is provided with a plurality of internal grooves 162 unequally spaced around its interior circumference adjacent its inner end, and a circumferential array of serrations 164 in its inner end face.

Pin section 34*c* has a solid cylindrical body portion 166, and a hollow, reduced diameter internally threaded inner end portion 168 with an unequally spaced array of exterior splines 170 spaced around its periphery and configured to be slidingly received in the interior grooves 162 of the pin section 32*c*. Disposed at the juncture of the body portion 166 and the end portion 168 is annular shoulder 172.

When the pin sections 32*c*,34*c* are operatively inserted into the sleeve member 30*c*, the splines 170 are received within the interior grooves 162 to thereby rotationally lock the inserted pin sections 32*c*,34*c* with the rotational orientations of the cams 54*c*,64*c* relative to the sleeve member 30*c* being identical. When the bolt 36*c* is then inserted and tightened into the internally threaded portion 168 of the pin section 34*c*, the pin sections 32*c*,34*c* are axially drawn toward one another in a manner intermeshing the serrations 160,164 and forcibly engaging the annular shoulder surfaces 158,172 (which could also be complementarily serrated if desired) to thereby rotationally lock the inserted pin sections 32*c*,34*c* within the sleeve member 30*c*.

The illustrated connector pin assembly 150 can be installed within the aligned openings 22,24 in the telescoped wear and support members 12,14 (see FIG. 1) in a manner similar to that utilized in conjunction with the previously described connector pin assembly embodiments, and the cams 54*c*,64*c* simultaneously rotationally adjusted by simply loosening the bolt 36*c*, simultaneously rotating the pin-coupled cams to new rotational orientations and then re-locking the cams in their "retightening" orientations by re-tightening the loosened bolt 36*c*

The foregoing detailed description is to be clearly understood as being given by way of illustration and example only, the spirit and scope of the present invention being limited solely by the appended claims.

What is claimed is:

1. Ground engaging apparatus comprising:

a connector pin assembly for captively retaining a wear member on a support member onto which the wear member is telescoped, the support member having a connector opening extending therethrough, said connector pin assembly including:

a tubular sleeve member longitudinally insertable into the connector opening, said sleeve member having an interior surface portion and being configured to be rotationally locked in said connector opening;

first and second longitudinal pin sections, at least one of which having a surface portion engageable with said interior surface portion of said sleeve member, said pin sections having inner end portions longitudinally insertable into opposite ends of said sleeve member in a manner positioning outer end portions of said pin sections externally of said opposite ends of said sleeve member, said outer end portions having laterally outwardly projecting eccentric configurations, said inner end portions of said pin sections being interlockable with one another, in response to insertion into said sleeve member, in a manner preventing relative rotation between said pin sections and causing said eccentric outer end portions of said pin sections to have identical rotational orientations relative to said sleeve member; and tightening structure for selectively tightening and loosening the engagement between said surface portions of said sleeve member and said at least one pin section to respectively prevent and permit conjoint rotation of the interlocked pin sections relative to said sleeve member.

2. The ground engaging apparatus of claim 1 wherein:

said eccentric outer end portions of said pin sections have cammed configurations with lobe portions.

3. The ground engaging apparatus of claim 2 wherein:

said inner end portions of said pin sections are configured in a manner such that they will interlock only when said lobe portions are facing in the same direction.

4. The ground engaging apparatus of claim 1 wherein:

said tightening structure includes an elongated threaded tightening member connectable to said pin sections and operable to selectively force them longitudinally toward or away from one another.

5. The ground engaging apparatus of claim 1 wherein:

said sleeve member has an external lateral projection thereon for use in rotationally locking said sleeve member in said connector opening.

6. The ground engaging apparatus of claim 1 wherein:

said surface portions of said sleeve member and said at least one pin section are relatively smooth and frictionally engageable with one another to prevent rotation of the interlocked pin sections relative to said sleeve member.

7. The ground engaging apparatus of claim 1 wherein:

said surface portions of said sleeve member and said at least one pin section have configurations permitting them to be mechanically interlocked in a manner blockingly preventing relative rotation between said sleeve member and said at least one pin section.

8. The ground engaging apparatus of claim 1 further comprising:

a support member through which the connector opening extends; and a hollow wear member rearwardly telescoped onto the support member and having an opposing pair of openings generally aligned with the connector opening, said wear member, in response to internal surface wear thereon, being rearwardly shiftable on the support member from an initial tightened position thereon to a rearwardly shifted position, said connector pin assembly being in an assembled state with said sleeve member being nonrotatably disposed in said support member connector opening and said outer pin section end portions being disposed in said opposing wear member openings and blocking forward removal of said wear member from said support member, and said outer pin section end portions being rotationally adjustable to engage rear surface portions of said opposing wear member openings with said wear member in each of said initially tightened and rearwardly shifted positions thereof.

9. The ground engaging apparatus of claim 8 wherein:

said support member is an adapter, and said wear member is a replaceable tooth point.

10. The ground engaging apparatus of claim 8 wherein:

said support member is a base adapter, and said wear member is an intermediate adapter.

11. Ground engaging apparatus comprising:

a support member through which a connector opening extends;

a hollow wear member rearwardly and removably telescoped onto said support member and having first and second opposed wall openings generally aligned with opposite ends of said connector opening; and a connector pin assembly captively retaining said wear member on said support member, said connector pin assembly including:

a tubular sleeve member longitudinally extending through said connector opening and being rotationally locked therein, said sleeve member having an interior surface area, a pin structure having a surface area, said pin structure longitudinally extending through said tubular sleeve and having outer end portions of laterally eccentric configurations disposed in said wear member wall openings and being locked to one another in identical rotational orientations relative to said sleeve member for conjoint rotation, and tightening structure operative to selectively (1) forcibly engage said surface areas of said sleeve member and said pin structure in a manner locking said pin structure in said sleeve member, or (2) loosen the engagement between said surface areas of said sleeve member and said pin structure to permit conjoint rotational adjustment of said laterally eccentric outer end portions of said pin structure.

12. The ground engaging apparatus of claim 11 wherein:

said pin structure includes first and second longitudinal pin sections having inner end portions disposed in said sleeve member and being releasably interlocked in a manner preventing relative rotation between said pin sections.

13. The ground engaging apparatus of claim 12 wherein:

said tightening structure includes an elongated threaded tightening member connected to said first and second pin sections and being rotatable relative thereto to selectively move them longitudinally toward or away from one another.

14. The ground engaging apparatus of claim 11 wherein;

said support member is an adapter, and said wear member is a replaceable tooth point.

15. The ground engaging apparatus of claim 11 wherein:

said support member is a base adapter, and said wear member is an intermediate adapter.

16. The ground engaging apparatus of claim 11 wherein:

said eccentric outer end portions of said pin structure have cammed configurations with lobe portions.

17. The ground engaging apparatus of claim 16 wherein:

said inner end portions of said pin sections are configured in a manner such that they will interlock only when said lobe portions are facing in the same direction.

18. The ground engaging apparatus of claim 11 wherein:

said support member and said sleeve member are spline-connected to one another.

19. The ground engaging apparatus of claim 11 wherein:

said longitudinal side surface portions of said sleeve member and said pin structure are mechanically interlocked with one another in a manner blockingly preventing relative rotation between said sleeve member and said pin structure.

20. The ground engaging apparatus of claim 11 wherein:

one of said laterally eccentric outer end portions of said pin structure has a non-circular opening formed therein for facilitating conjoint rotational adjustment of said laterally eccentric outer end portions of said pin structure relative to said sleeve member.

21. Ground engaging apparatus comprising:

a connector pin assembly for captively retaining a wear member on a support member onto which the wear member is telescoped, the support member having a connector opening extending therethrough, said connector pin assembly including:

a tubular sleeve member having an interior surface area and being configured to be inserted into, and rotationally locked within, the connector opening;

a pin structure having a longitudinally intermediate portion and generally cam-shaped outer end portions, said longitudinally intermediate portion being rotatably positionable within said sleeve member with said outer end portions being disposed externally of said sleeve member, said outer end portions being lockable in identical rotational orientations relative to said longitudinally intermediate portion in response to insertion of said longitudinally intermediate portion into said sleeve member, and locking structure selectively operable to forcibly engage said longitudinally intermediate pin structure portion with said interior surface area and disengage said longitudinally intermediate pin structure portion therefrom to respectively rotationally lock and unlock said intermediate pin structure portion within said sleeve member.

22. The ground engaging apparatus of claim 21 wherein:

said ground engaging apparatus further comprises a support member through which the connector opening extends, and a hollow wear member rearwardly telescoped onto said support member and having an opposing pair of openings generally aligned with said connector opening, and said longitudinally intermediate pin structure portion is operatively received in said sleeve member and said generally cam-shaped outer end portions of said pin structure are received in said opposing pair of wear member openings.

* * * * *